US007212169B2

(12) United States Patent
Ogawa et al.

(10) Patent No.: US 7,212,169 B2
(45) Date of Patent: May 1, 2007

(54) LENS ANTENNA APPARATUS

(75) Inventors: Takaya Ogawa, Kawasaki (JP); Nobufumi Saruwatari, Yokosuka (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/989,334

(22) Filed: Nov. 17, 2004

(65) Prior Publication Data

US 2005/0212711 A1 Sep. 29, 2005

(30) Foreign Application Priority Data

Nov. 28, 2003 (JP) ..... 2003-400579

(51) Int. Cl.
*H01Q 19/06* (2006.01)

(52) U.S. Cl. ..... 343/753; 343/757; 343/911 R

(58) Field of Classification Search ..... 343/753, 343/909, 757, 758, 911 R
See application file for complete search history.

(56) References Cited

U.S. PATENT DOCUMENTS 6,329,956 B1 12/2001 Tateishi et al.
2002/0180393 A1 12/2002 Slater et al.

FOREIGN PATENT DOCUMENTS

| | | |
|---|---|---|
| JP | 2001-44746 | 2/2001 |
| JP | 2002-513230 | 5/2002 |
| JP | 2002-513231 | 5/2002 |
| JP | 2002-232230 | 8/2002 |
| JP | 2003-110352 | 4/2003 |
| JP | 2003-188640 | 7/2003 |
| JP | 2003-400579 | 11/2003 |
| WO | WO 99/56347 | 11/1999 |
| WO | WO 99/56348 | 11/1999 |

*Primary Examiner*—Michael C. Wimer
(74) *Attorney, Agent, or Firm*—Oblon, Spivak, McClelland, Maier & Neustadt, P.C.

(57) ABSTRACT

In a lens antenna apparatus, a guide rail is formed along the outer surface of a hemispherical lens of a hemispherical lens antenna, and a plurality of radiators are positioned and fixed on the guide rail. When the lens antenna apparatus operates, the directivity of radio beams of the radiators is controlled by adjusting an AZ-axis rotating mechanism, an EL-axis rotating mechanism and an xEL-axis rotating mechanism.

10 Claims, 5 Drawing Sheets

LENS ANTENNA APPARATUS

CROSS-REFERENCE TO RELATED APPLICATIONS

This application is based upon and claims the benefit of priority from prior Japanese Patent Application No. 2003-400579, filed Nov. 28, 2003, the entire contents of which are incorporated herein by reference.

BACKGROUND OF THE INVENTION

1. Field of the Invention

The present invention relates to a lens antenna apparatus utilizing a spherical lens that focuses radio beams, which is used in ground stations of a satellite communication system. More particularly, the invention relates to a lens antenna apparatus having a configuration suitable to be mounted on a mobile unit.

2. Description of the Related Art

Conventionally, a lens antenna apparatus utilizing a spherical lens capable of focusing radio beams has been developed. Radiators are arranged in given positions on the lower hemisphere of the spherical lens, and the directivity of the radiators are aligned with the center of the spherical lens to form radio beams in a given direction. The radio beams can be oriented everywhere in the celestial sphere only by freely moving the radiators on the lower hemisphere of the spherical lens. The lens antenna apparatus therefore has the advantage that it need not rotate as a whole unlike a parabolic antenna apparatus and its driving system can easily be downsized.

Under the present circumstances, however, the lens antenna apparatus is difficult to miniaturize further because of constraints of downsizing of the spherical lens in itself. Further, the apparatus is not easy to handle during assembly since it is spherical. To resolve these problems, the following hemispherical lens antenna apparatus is disclosed in, for example, Jpn. Pat. Appln. KOKAI Publications Nos. 2002-232230and 2003-110352. An upper hemispherical lens, which is formed by halving a spherical lens, is placed on a radio reflector to focus radio waves from the celestial sphere, and the reflector reflects the radio waves, thus acquiring the radio waves on the outer surface of the hemispherical lens.

The hemispherical lens antenna apparatus has received attention as one mounted on a mobile unit since it is easy to miniaturize, whereas it needs to communicate with a plurality of stationary satellites on a stationary orbit. It is thus desirable to achieve a multibeam lens antenna apparatus having a simple and stable configuration.

BRIEF SUMMARY OF THE INVENTION

An object of the present invention is to provide a multibeam lens antenna apparatus having a simple and stable configuration which is suitable to be mounted on a mobile unit.

A lens antenna apparatus according to an aspect of the present invention comprises a fixed base horizontally located in an installation position;

a rotating base mounted on the fixed base rotatably on an azimuth axis, a hemispherical lens antenna mounted on the rotating base and having a radio reflector on which a hemispherical lens is placed, the hemispherical lens being formed by halving a spherical lens that focuses radio beams, a guide rail formed along an outer surface of the hemispherical lens and supported based on an elevation axis perpendicular to the azimuth axis, the azimuth axis passing through a center point of the hemispherical lens, a plurality of radiators arranged opposite to the hemispherical lens in given positions on the guide rail and each having an antenna element that forms radio beams focused by the hemispherical lens, an AZ-axis rotating mechanism which rotates the rotating base on the azimuth axis, an EL-axis rotating mechanism which rotates the guide rail on the elevation axis, and a radiator moving mechanism which moves the radiators along the guide rail with a fixed interval between the radiators, wherein a directivity of radio beams of the radiators is controlled by adjusting the AZ-axis rotating mechanism, the EL-axis rotating mechanism, and the radiator moving mechanism.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

An embodiment of the present invention will be described below with reference to the accompanying drawings.

Figure 1A:
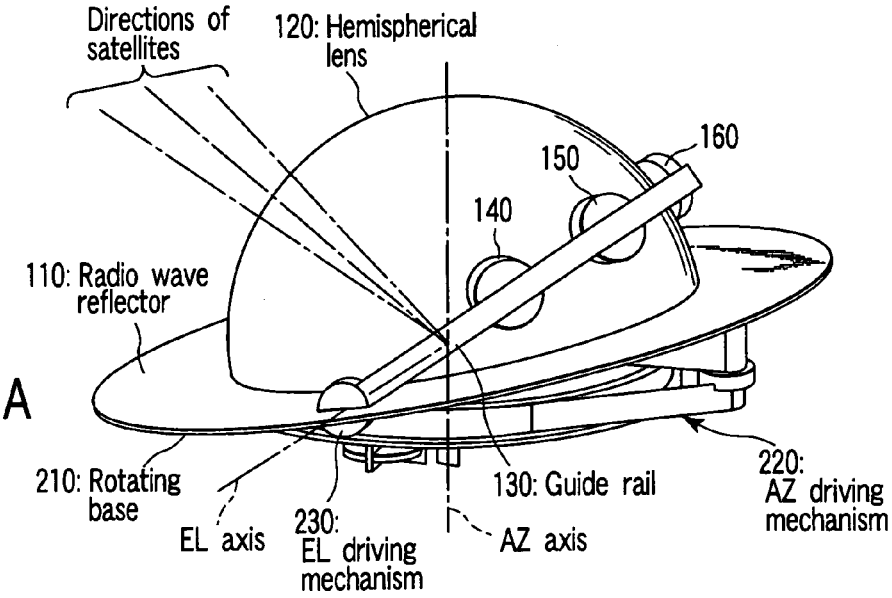
FIGS. 1A, 1B and 1C are schematic views showing a basic configuration of a lens antenna apparatus according to an embodiment of the present invention.
Figure 1B:
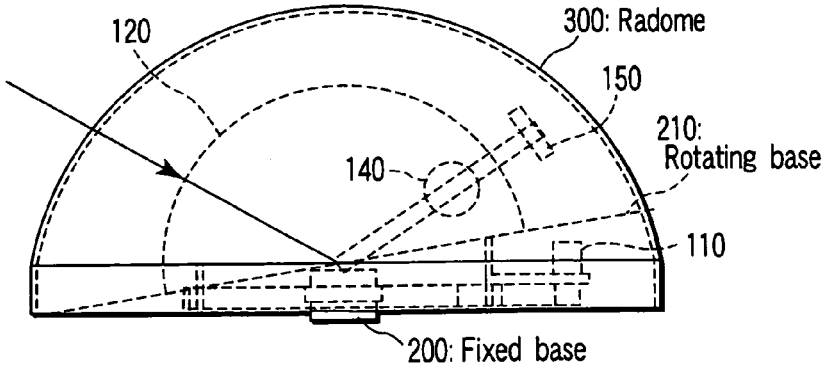
Figure 1C:
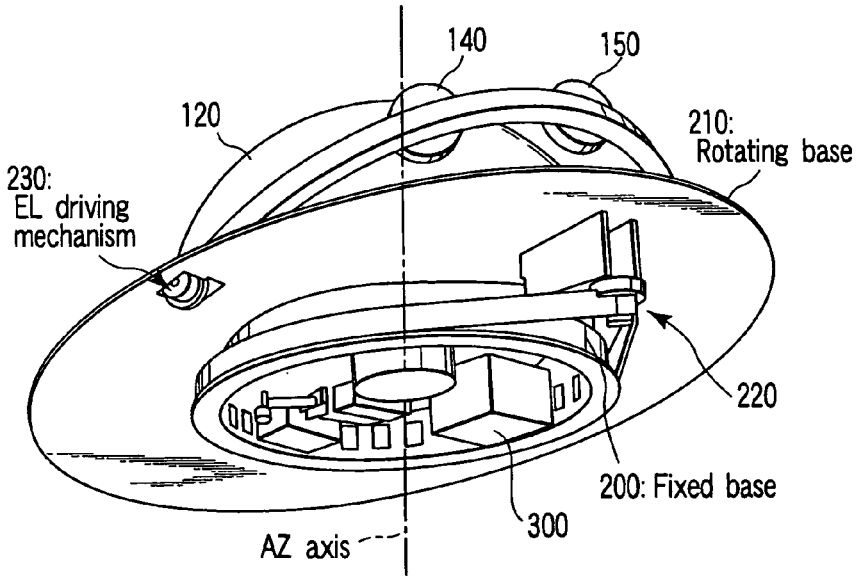
Figure 2:
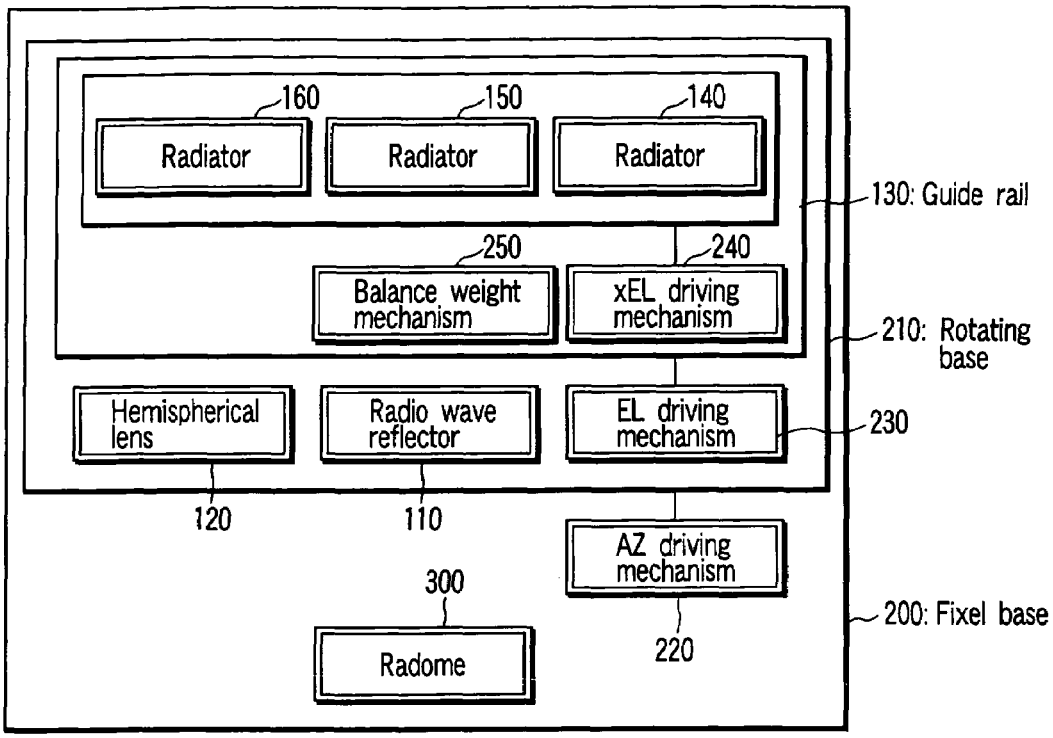
FIG. 2 is a conceptual diagram showing a relationship in connection among respective components of the apparatus shown in FIGS. 1A, 1B and 1C.

FIGS. 1A, 1B and 1C are schematic views showing a basic configuration of a lens antenna apparatus according to an embodiment of the present invention. FIG. 1A is a perspective view of the lens antenna apparatus viewed obliquely from top, FIG. 1B is a side view thereof, and FIG. 1C is a perspective view thereof viewed obliquely from bottom. FIG. 2 is a conceptual diagram showing a relationship in connection among respective components of the apparatus shown in FIGS. 1A to 1C. Assume here that the apparatus is mounted on a mobile unit to communicate with each of three communication satellites (not shown but referred to as stationary satellites hereinafter) on a stationary orbit.

The lens antenna apparatus shown in FIGS. 1A to 1C comprises an antenna unit 100. The antenna unit 100 includes a radio wave reflector 110, a hemispherical lens 120, and a guide rail 130. The hemispherical lens is placed on the reflector 110. The hemispherical lens 120 is formed by halving a spherical lens called Luneberg. The guide rail 130 is formed semicircularly along the outer surface of the lens 120.

Idealistically, it is desirable that the radio wave reflector 110 be a plane expanding infinitely. Actually, its size is determined by the tolerance of antenna characteristics (e.g., gain and side lobe).

The spherical lens is also called a spherical dielectric lens. This lens is configured by dielectrics laminated concentrically on a sphere to allow almost parallel radio waves to pass therethrough and focus them on a point. In general, the laminated dielectrics decrease in dielectric constants toward the outer surface of the lens. The hemispherical lens 120 of the present embodiment is formed by halving the spherical lens equally, and the radio wave reflector 110 is placed on the flat bottom of the hemispherical lens 120. It can thus be treated as a spherical lens in substance.

The antenna unit 100 receives radio waves from stationary satellites through the side surface of the hemispherical lens 120. If a spherical lens is used, radio waves are focused inside the lens. Since the hemispherical lens is used and placed on the radio wave reflector 110 in the present embodiment, the radio waves focused on the hemispherical lens 120 are reflected by the reflector 110, or the flat bottom of the lens 120. The route of radio waves incident upon the hemispherical lens 120 is diametrically opposed to that of radio waves incident upon a spherical lens with regard to a plane. Radiators 140, 150 and 160 are arranged in the focusing positions of radio beams formed on the side surface of the hemispherical lens 120, namely, the focal points. Thus, the radiators 140, 150 and 160 can receive radio waves from three stationary satellites and transmit radio waves thereto.

The antenna unit 100 is mounted on a rotating base 210. The rotating base 210 is placed on a fixed based 200 such that it can freely rotate on an azimuth (AZ) axis. The rotating base 210 has an AZ driving mechanism 220 on its underside. The AZ driving mechanism rotates the rotating base 210 on the AZ axis on the fixed base 200.

Usually, the antenna unit 100 is located almost horizontally and the radiators 140, 150 and 160 are arranged thereon in conformity with the direction and elevation angle of the stationary satellites for communications with the lens antenna apparatus. If, however, the apparatus is used near the equator, on a sloping ground in an intermontane region, etc., the incident and outgoing angles of radio waves on and from the hemispherical lens 120 will become acute and the radiators 140, 150 and 160 will block the radio waves. To avoid this, as shown in FIGS. 1A to 1C, the antenna unit 100 on the rotating base 210 is tilted adequately from the horizontal surface of the fixed base 200. The radiators 140, 150 and 160 can thus be arranged to fall outside the range of a block against the radio waves.

The guide rail 130 is formed to extend from the rotating base 210 along the outer surface of the hemispherical lens 120. It freely rotates on an elevation (EL) axis that is perpendicular to the azimuth (AZ) axis that passes through the center point of the hemispherical lens 120. An EL driving mechanism 230 is provided at one end of the guide rail 130 in order to rotate the guide rail 130 on the EL axis.

The three radiators 140, 150 and 160 are provided on the guide rail 130 and each have an antenna element for forming radio beams focused by the hemispherical lens 120. These radiators are arranged opposed to the hemispherical lens 120 at their respective locations. The locations and polarized axes of the radiators 140, 150 and 160 are determined in accordance with the directions of stationary satellites corresponding thereto when the apparatus is initialized. The radiators 140, 150 and 160 can be arranged on the same guide rail 130 since their partners for communications are stationary satellites.

The guide rail 130 includes a mechanism 240 for controlling the movement of the radiators 140, 150 and 160 along the guide rail 130 with their locations maintained for tracking the satellites. This mechanism will be referred to as a cross elevation (xEL) driving mechanism hereinafter.

Figure 3:
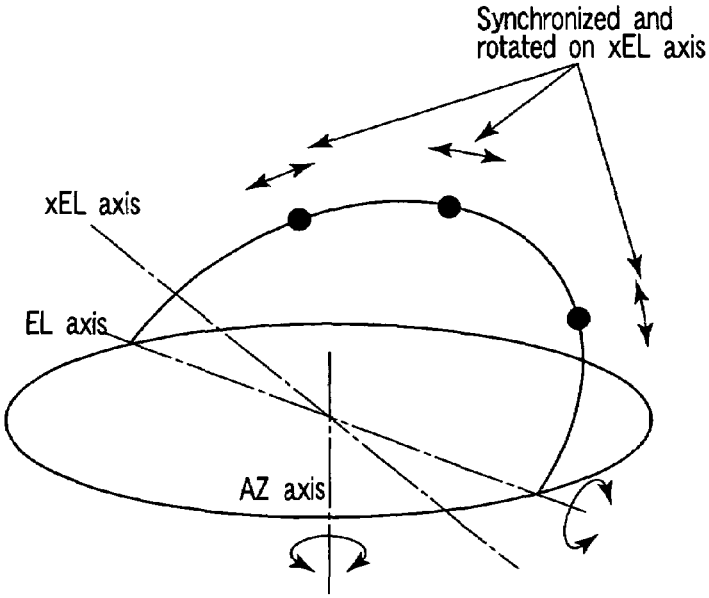
FIG. 3 is a schematic, perspective view of three driving mechanisms that rotate on an AZ axis, an EL axis and a xEL axis, respectively in the apparatus shown in FIGS. 1A, 1B and 1C.

In the forgoing lens antenna apparatus, as shown in FIG. 3, the locations of the radiators 140, 150 and 160 can freely be adjusted along the outer surface of the hemispherical lens 120 while keeping the interval between the radiators by the three AZ, EL and xEL driving mechanisms. Thus, the radiators 140, 150 and 160 can always track the three stationary satellites.

Since the radiators 140, 150 and 160 and xEL driving mechanism 240 applies an excessive weight to the support portion of the guide rail 130, the guide rail 130 is difficult to adjust finely when rotating on the EL axis. It is thus desirable to provide a balance weight mechanism 250 close to the EL axis of the guide rail 130 to reduce the above weight applied to the guide rail 130.

The rotating base 210 includes a control unit 300 for automatically controlling the directivity of radio beams so as to track the satellites for communications with the antenna apparatus by adjusting the AZ-axis rotating mechanism 220, EL driving mechanism 230, and xEL driving mechanism 240, as illustrated in FIG. 1C.

Figure 4B:
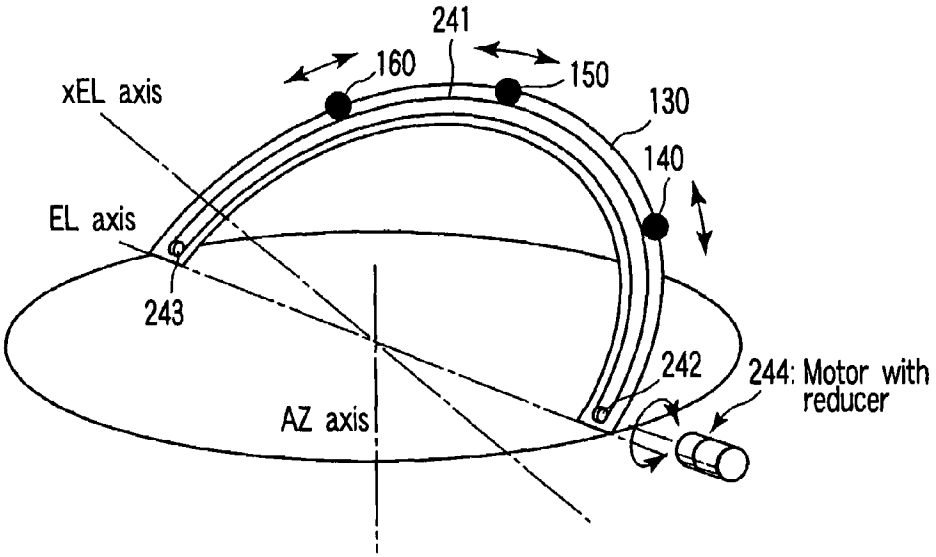
FIGS. 4A, 4B and 4C are diagrams showing a wire-type configuration that implements an xEL driving mechanism in the apparatus shown in FIGS. 1A, 1B and 1C.
Figure 4C:
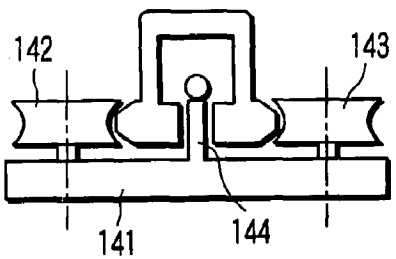
Figure 4A:
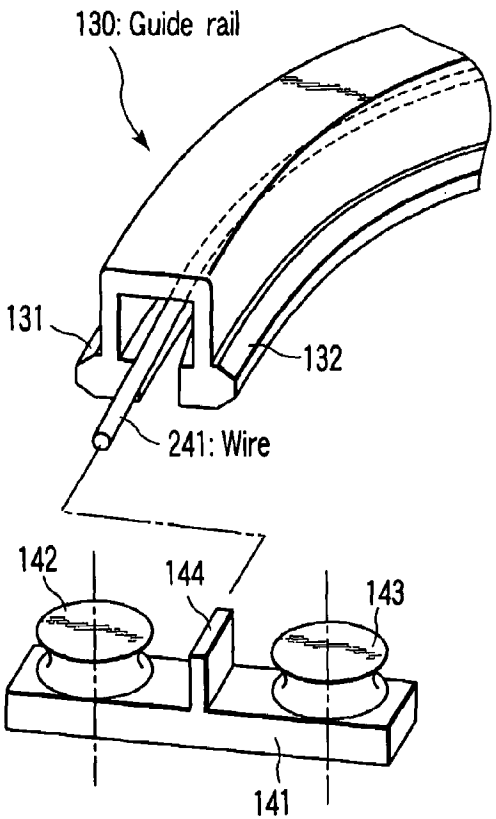

FIGS. 4A, 4B and 4C show a wire-type configuration that implements the xEL driving mechanism 240 described above. FIG. 4A is a schematic perspective view of the configuration, FIG. 4B is a detailed perspective and partly sectional view thereof, and FIG. 4C is a sectional view thereof. In the wire-type configuration, the guide rail 130 is hollowed. A loop-shaped wire 241 passes through the hollow of the guide rail 130 and is put on pulleys 242 and 243 at both ends of the guide rail 130. One (242) of the pulleys is rotated in a forward or backward direction by a motor 244 with a reducer. Thus, the wire 241 moves back and forth, and the radiators 140, 150 and 160 are fixed on one side of the wire 241.

As shown in FIG. 4A, the guide rail 130 has an opening toward the surface of the hemispherical lens 120 and guide frames 131 and 132 on its both sides. Each of the radiators (e.g., the radiator 140 shown in FIG. 4A) has pulleys 142 and 143 at its proximal end 141. These pulleys 142 and 143 are fitted to the guide frames 131 and 132, respectively. The radiator 140 also has a projected piece 144 in its middle. The projected piece 144 is inserted into the opening of the guide rail 130 and connected to the wire 241 therein. With this configuration, the radiators 140, 150 and 160 can move together smoothly along the guide rail 130 as the wire 241 moves.

Figure 5:
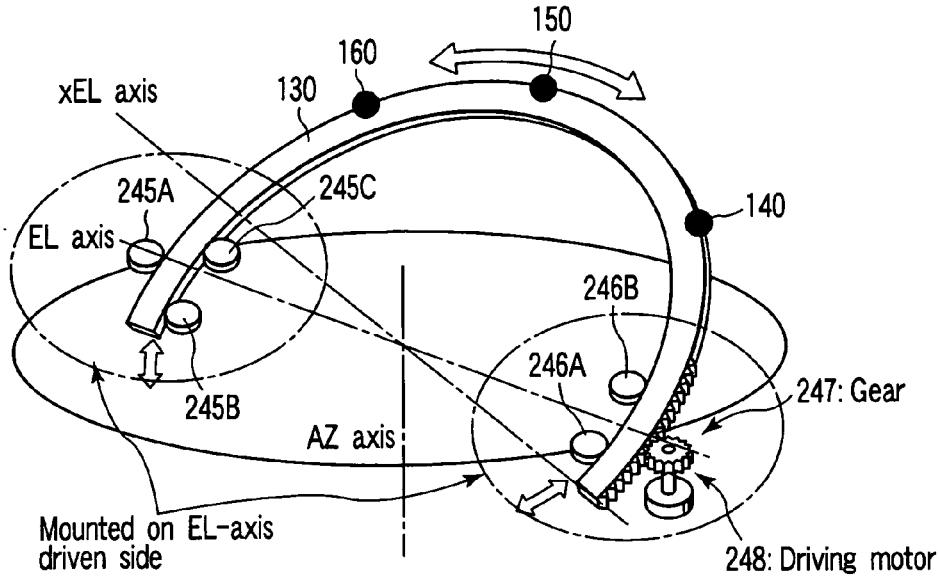
FIG. 5 is a diagram showing a V roller gear type configuration that implements a xEL driving mechanism in the apparatus shown in FIGS. 1A, 1B and 1C.

FIG. 5 shows a V roller gear type configuration as another type of the xEL driving mechanism 240 described above. In this configuration, the guide rail 130 is lengthened more than half the circumference of a virtual circle to be formed by the guide rail. One end of the guide rail 130 has recesses on its inner and outer surfaces, whereas the other end thereof has a recess on its inner surface and a gear groove on its outer surface. Above the rotating base 210 and below the EL axis, the inner and outer surfaces of one end of the guide rail 130 are supported slidably by three V rollers 245A, 245B and 245C and the inner surface of the other end thereof is supported by two V rollers 246A and 246B. A gear 247 is fitted into the gear groove, and a driving motor 248 to which the gear 247 is coupled is rotated forward or backward. Since the entire guide rail can rotate along the outer surface of the hemispherical lens 120, the radiators 140, 150 and 160 have only to be fixed directly to the guide rail 130. Though the wire-type configuration is complicated, a relatively stable EL driving operation can be expected because the center of gravity of the entire guide rail 130 lowers.

Figure 6:
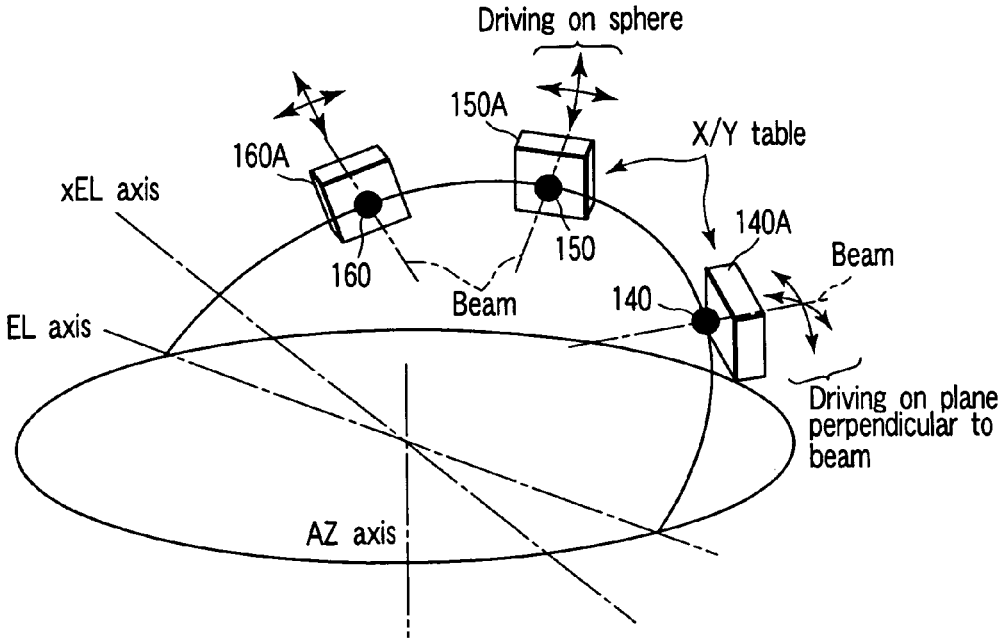
FIG. 6 is a perspective view of the apparatus shown in FIGS. 1A, 1B and 1C which includes radiators each having an X/Y table for fine-tracking.

If the aperture of the antenna apparatus increases and the angle of the beams becomes acute to reduce the precision of tracking at the AZ, EL and xEL axes, X/Y tables 140A, 150A and 160A can be provided on their respective support portions of the radiators 140, 150 and 160. These support sections are located on a partial sphere and at a fixed distance from the center of the lens or on the plane perpendicular to the beams that form a quasi-sphere, as shown in FIG. 6. In the V roller gear type configuration, coarse adjustment (low frequency, large amplitude) is performed by the AZ, EL and xEL axes, while fine adjustment (high frequency, small amplitude) is done by the X/Y tables to track the stationary satellites with reliability. Originally, three axes are required even for the fine adjustment, namely, two axes of X/Y tables plus one axis in the direction of polarized axis. In the configuration shown in FIG. 6, however, only the driving mechanism of the polarized axis, which is not so sensitive in terms of tracking, is not synthesized with but can be separated from the other two axes. The driving mechanism can thus be omitted.

Figure 7:
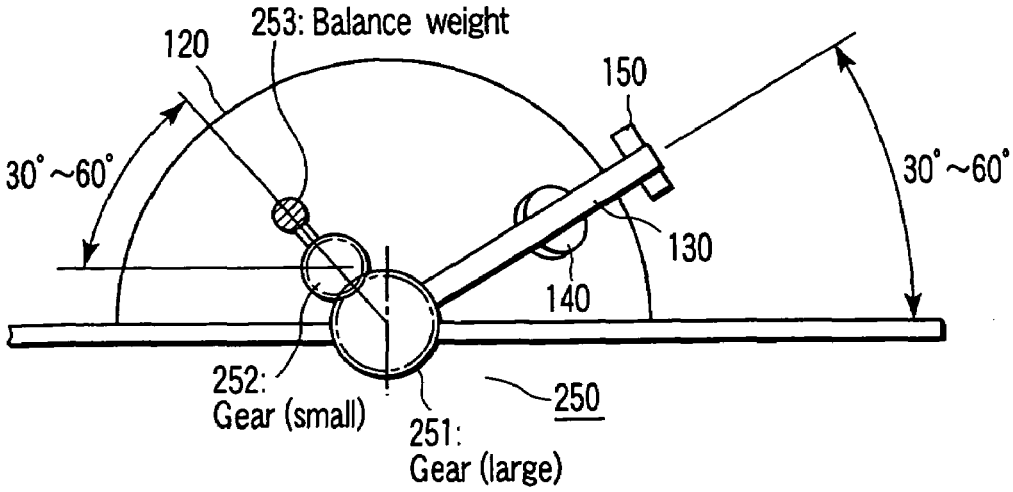
FIG. 7 is a side view of the apparatus shown in FIGS. 1A, 1B and 1C in which a balance weight mechanism is implemented by a spur gear for the EL driving of a guide rail.

FIG. 7 shows a configuration of the balance weight mechanism 250 that is implemented by a spur gear for the EL driving of the guide rail 130. In this configuration, a large-diameter first gear 251 is fitted to the guide rail 130 to rotate on the EL axis, and a small-diameter second gear 252 is engaged with the first gear 251 and fixed to the rotating base 210. A balance weight 253 is attached to the second gear 252 in a predetermined direction.

The balance weight 253 can almost cancel an imbalance caused around the EL axis of the guide rail 130 located at an angle close to 45 degrees while the guide rail 130 is located at an angle ranging from 30 degrees to 60 degrees. When the guide rail 130 is located at an angle of almost 45 degrees, the balance weight 253 is located at an angle of 45 degrees, thereby almost keeping a counterbalance. In this case, the weight of the balance weight 253 is based on the axle ratio and the mass of the whole balance weight is reduced by the reducer on the EL axis. A balance between the guide rail 130 and balance weight 253 is kept on the EL axis to minimize the influence of a disturbance (translational vibration) on the torque of a motor. It is desirable that the reducer be free of backlash and the structural elements have adequate stiffness against control frequency.

Figure 8:
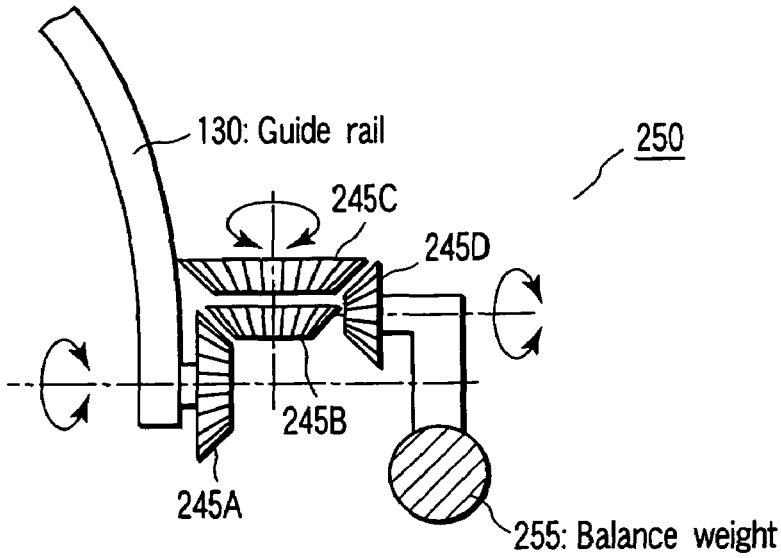
FIG. 8 is a side view of the apparatus shown in FIGS. 1A, 1B and 1C in which a balanced-weight mechanism is implemented by a bevel gear for the EL driving of the guide rail.

FIG. 8 shows another configuration of the balance weight mechanism 250 that is implemented by a bevel gear. In this configuration, a first bevel gear 245A is fitted to the guide rail 130 to rotate on the EL axis. A second bevel gear 245B is engaged with the first bevel gear 254A. A fourth bevel gear 245D is engaged with a large-diameter third bevel gear 254C that is coaxial with the second bevel gear 245B. A balance weight 255 is attached to the fourth bevel gear 245D and extended in a direction perpendicular to the rotating axis of the gear 245D. In this configuration, too, the balance weight 255 can almost cancel an imbalance caused around the EL axis of the guide rail 130.

In the embodiment described above, the algorithm for tracking stationary satellites rotates the guide rail 130 on the AZ and EL axes to coincide with the celestial equator (simply referred to as the equator hereinafter) and controls the antenna apparatus such that its directivity coincides with the satellites on the equator. The interval between satellites on the equator is fixed, as is the polarization angle of the satellites to the equator. Multibeams can thus be transmitted to all the satellites at once only by the above control.

It is assumed that the lens antenna apparatus will be subjected to a great disturbance in inoperative mode. It is thus desirable that the axis driving mechanisms each have a retreat mode in which a stall lock or a non-energization brake prevents the disturbance from being applied to the driving unit and structural element.

When the lens antenna apparatus uses multibeams, if its antenna aperture is used for some of the multibeams only to be received, the apparatus has an adequate gain. As for an antenna apparatus that can be decreased in beam tracking precision, its radiators can be displaced from the focal point of a lens to broaden the range of beams, with the result that a driving mechanism for fine adjustment can be omitted.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A lens antenna apparatus comprising:

a fixed base horizontally located in an installation position;

a rotating base mounted on the fixed base rotatably on an azimuth axis;

a hemispherical lens antenna mounted on the rotating base and having a radio reflector on which a hemispherical lens is placed, the hemispherical lens being formed by halving a spherical lens that focuses radio beams;

a guide rail formed along an outer surface of the hemispherical lens and supported based on an elevation axis perpendicular to the azimuth axis, the azimuth axis passing through a center point of the hemispherical lens;

a plurality of radiators arranged opposite to the hemispherical lens in given positions on the guide rail and each having an antenna element that forms radio beams focused by the hemispherical lens;

an AZ-axis rotating mechanism which rotates the rotating base on the azimuth axis;

an EL-axis rotating mechanism which rotates the guide rail on the elevation axis; and a radiator moving mechanism which moves the radiators along the guide rail with a fixed interval between the radiators, wherein a directivity of radio beams of the radiators is controlled by adjusting the AZ-axis rotating mechanism, the EL-axis rotating mechanism, and the radiator moving mechanism, the radiators communicate with respective communication satellites arranged on a stationary orbit, the radiators are directly fixed to the guide rail in directions of the communication satellites when the apparatus is initialized, and the radiator moving mechanism moves the guide rail in a circumferential direction.

2. The lens antenna apparatus according to claim 1, wherein the radiators include an adjusting mechanism to adjust a focal point of radio waves of the antenna element in a fixed support section, the adjusting mechanism adjusting a position of the antenna element on a partial sphere and at a fixed distance from the center point of the hemispherical lens, or on a plane perpendicular to beams that form a quasi-sphere.

3. The lens antenna apparatus according to claim 1, further comprising a balance weight mechanism attached to at least one end of the guide rail to cancel an imbalance caused when the guide rail is rotated by the EL-axis rotating mechanism, the balance weight mechanism comprising an auxiliary shaft extending parallel to the EL axis at a predetermined ratio and in an opposite direction, and balance weights mounted on the auxiliary shaft for canceling the imbalance.

4. The lens antenna apparatus according to claim 1, further comprising a control unit which automatically controls the directivity of the radio beams so as to track satellites for communications with the apparatus by adjusting the Z-axis rotating mechanism, the EL-axis rotating mechanism, and the radiator moving mechanism.

5. The lens antenna apparatus according to claim 1, wherein the AZ-axis rotating mechanism, the EL-axis rotating mechanism, and the radiator moving mechanism each includes fixing means for fixing a movable portion at a predetermined position by a lock or a brake.

6. A lens antenna apparatus comprising:

a fixed base horizontally located in an installation position;

a rotating base mounted on the fixed base rotatably on an azimuth axis;

a hemispherical lens antenna mounted on the rotating base and having a radio reflector on which a hemispherical lens is placed, the hemispherical lens being formed by halving a spherical lens that focuses radio beams;

a guide rail formed along an outer surface of the hemispherical lens and supported based on an elevation axis perpendicular to the azimuth axis, the azimuth axis passing through a center point of the hemispherical lens;

a wire extended along the guide rail;

a plurality of radiators arranged opposite to the hemispherical lens in given positions on the wire and each having an antenna element that forms radio beams focused by the hemispherical lens;

an AZ-axis rotating mechanism which rotates the rotating base on the azimuth axis;

an EL-axis rotating mechanism which rotates the guide rail on the elevation axis; and a radiator moving mechanism which moves the radiators along the guide rail with a fixed interval between the radiators, wherein a directivity of radio beams of the radiators is controlled by adjusting the AZ-axis rotating mechanism, the EL-axis rotating mechanism, and the radiator moving mechanism, the radiators communicate with respective communication satellites arranged on a stationary orbit, the radiators are directly fixed to the wire in directions of the communication satellites when the apparatus is initialized, and the radiator moving mechanism moves the wire along the guide rail.

7. The lens antenna apparatus according to claim 6, wherein the radiators include an adjusting mechanism to adjust a focal point of radio waves of the antenna element in a fixed support section, the adjusting mechanism adjusting a position of the antenna element on a partial sphere and at a fixed distance from the center point of the hemispherical lens, or on a plane perpendicular to beams that form a quasi-sphere.

8. The lens antenna apparatus according to claim 6, further comprising a balance weight mechanism attached to at least one end of the guide rail to cancel an imbalance caused when the guide rail is rotated by the EL-axis rotating mechanism, the balance weight mechanism comprising an auxiliary shaft extending parallel to the EL axis at a predetermined ratio and in an opposite direction, and balance weights mounted on the auxiliary shaft for canceling the imbalance.

9. The lens antenna apparatus according to claim 6, further comprising a control unit which automatically controls the directivity of the radio beams so as to track satellites for communications with the apparatus by adjusting the Z-axis rotating mechanism, the EL-axis rotating mechanism, and the radiator moving mechanism.

10. The lens antenna apparatus according to claim 6, wherein the AZ-axis rotating mechanism, the EL-axis rotating mechanism, and the radiator moving mechanism each includes fixing means for fixing a movable portion at a predetermined position by a lock or a brake.

* * * * *